US007557285B2

(12) United States Patent
Ward

(10) Patent No.: US 7,557,285 B2
(45) Date of Patent: Jul. 7, 2009

(54) CAPO DEVICE WITH SELECTIVE STRING COMPRESSION

(76) Inventor: Michael Ward, 27931 Oklarda Cir., Easton, MD (US) 21601

( * ) Notice: Subject to any disclaimer, the term of this patent is extended or adjusted under 35 U.S.C. 154(b) by 0 days.

(21) Appl. No.: 11/391,768

(22) Filed: Mar. 28, 2006

(65) Prior Publication Data

US 2007/0227334 A1 Oct. 4, 2007

(51) Int. Cl.
*G10D 3/00* (2006.01)

(52) U.S. Cl. ..... 84/422.1; 84/315; 84/317; 84/318

(58) Field of Classification Search ..... 84/422, 84/290, 297 R, 323, 324, 450, 454, 455, 458, 84/459, 422.1; D17/14, 20, 21, 99
See application file for complete search history.

(56) References Cited

U.S. PATENT DOCUMENTS 3,680,427 A * 8/1972 Valentino ..... 84/456
3,818,793 A * 6/1974 Round ..... 84/454
3,915,051 A * 10/1975 Kincaid ..... 84/317
3,995,523 A * 12/1976 Clarke ..... 84/317
4,334,457 A * 6/1982 Spoonts, III ..... 84/318
4,926,732 A * 5/1990 Collins et al. ..... 84/318
5,323,676 A * 6/1994 Kennedy ..... 84/317
5,623,110 A * 4/1997 Hoglund et al. ..... 84/318
6,410,832 B1 * 6/2002 Sterner ..... 84/318

FOREIGN PATENT DOCUMENTS

DE 3413356 A * 10/1985

* cited by examiner

*Primary Examiner*—Jeffrey Donels
*Assistant Examiner*—Christopher Uhlir
(74) *Attorney, Agent, or Firm*—Adams & Wilks

(57) ABSTRACT

A capo device has a clamping assembly and individually selectable pressure pad assemblies for compressing selected strings of a stringed instrument to selectively tune the stringed instrument. The pressure pad assemblies are adapted to be selectively vertically lifted or lowered relative to the strings of the stringed instrument to vary the permutations for chord tunings.

15 Claims, 6 Drawing Sheets

FIG. 3
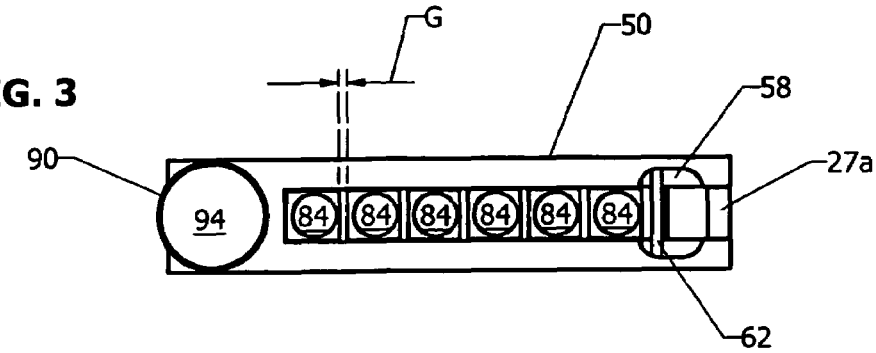
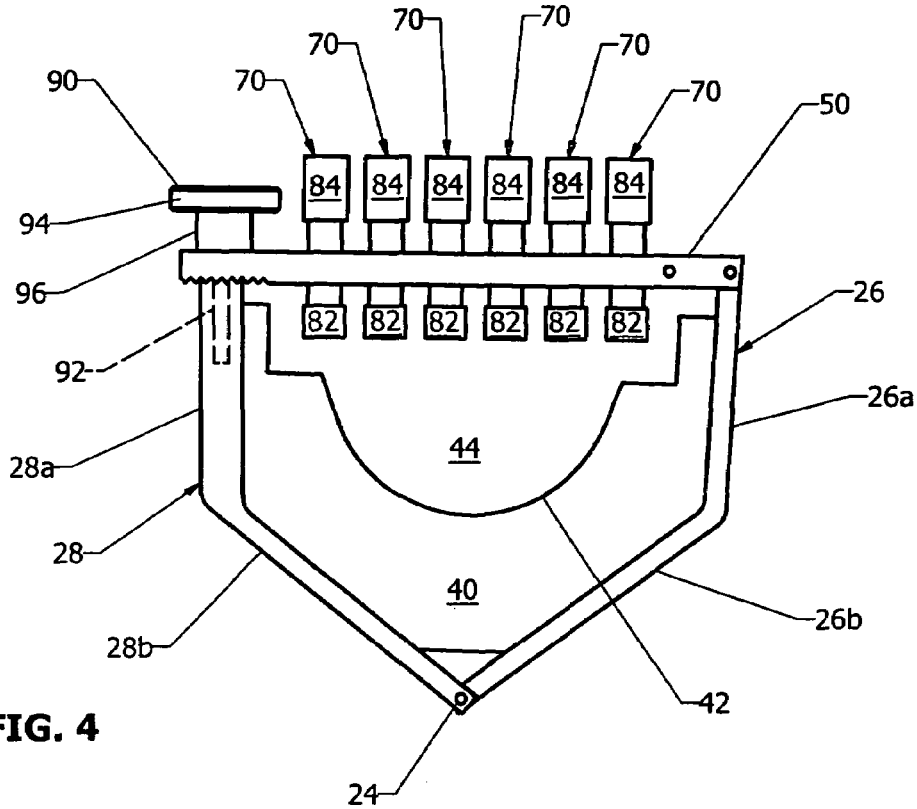
FIG. 4
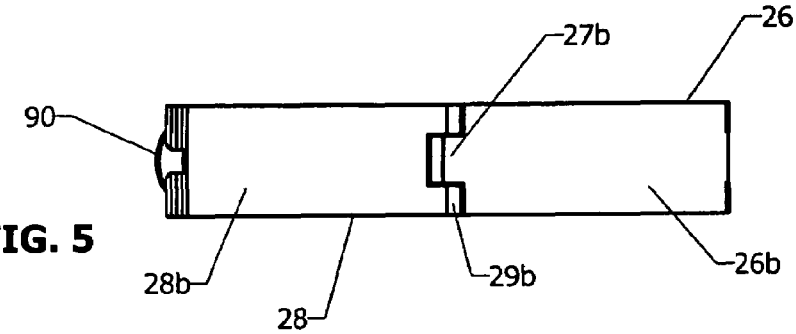
FIG. 5

CAPO DEVICE WITH SELECTIVE STRING COMPRESSION

BACKGROUND OF THE INVENTION

1. Field of the Invention

The present invention relates to capos and, more particularly, to a capo device constructed and arranged to permit selective string compression.

2. Background Information

A capotasto (hereinafter referred to as a "capo") applies compression simultaneously to some or all strings at the same fret of a stringed musical instrument. Examples of conventional partial capos (capos providing selective compression) are described in U.S. Pat. Nos. 5,623,110, 4,334,457 and 4,183,279.

The conventional capos are constructed to use straps or other means of attachment of the capos to the fretboard of the stringed instrument and are cumbersome to use. Thus, the conventional capos have been difficult to use because they are not easily attached and detached in an expeditious fashion while also being capable of producing a precise compression suitable for an expert guitarist.

Moreover, the conventional capos do not provide a toggle pad that can be easily lifted from and lowered to a compression state to vary the tuning of a chord by simply turning a knob wherein the knob can be used by the guitarist to adjust the toggle pad in both the X-axis and Y-axis. Furthermore, the toggle pad cannot be adjusted in both the X-axis and Y-axis quickly and conveniently while the capo is installed.

Moreover, conventional capos do not provide a clamping assembly that includes a two-piece rigid yoke hinged by a pin and having a cushioned cradle wherein the yoke is capable of expansion and contraction along the X-axis as the capo is slid or moved up and down the fretboard. Furthermore, the conventional capos do not provide a universally adaptable fretboard clamping assembly that allows the assembly to be easily locked and unlocked by a simple turn of a fastener or knurled screw.

SUMMARY OF THE INVENTION

It is an object of the present invention to provide a capo device which is easily attached to and detached from the fretboard of a stringed instrument in an expeditious fashion.

It is another object of the present invention to provide a capo device which is capable of producing a precise compression suitable for an expert guitarist.

It is another object of the present invention to provide a capo device having a universally adaptable fretboard clamping assembly that allows the assembly to be easily locked and unlocked relative to the fretboard of a stringed instrument.

It is another object of the present invention to provide a capo device which is simple to use and economical to manufacture.

It is yet another object of the present invention to provide a method of tuning a stringed instrument using the capo device according to the present invention.

The foregoing and other objects of the present invention are carried out by a capo device comprising a clamp assembly and a plurality of pad assemblies. The clamp assembly has a yoke and a strut. The strut has a first end hingedly coupled to a first side of the yoke, a second end securable to a second side of the yoke, and a slide channel arranged to traverse a longitudinal axis of a length of strings on a stringed instrument. Each of the pad assemblies is mounted for undergoing slidable movement in the slide channel of the strut in the direction traversing the longitudinal axis of the instrument strings to a position over an underlying string and for being selectively vertically lowered to compress the underlying string.

In a preferred embodiment, the clamp assembly further comprises an elastomeric member received in the yoke, the elastomeric member having a concave recess formed therein to provide a cradle for a fretboard of the stringed instrument. The yoke preferably comprises a two-piece member hinged together via a hinge pin for undergoing pivotal movement relative one another and relative to the fretboard of the stringed instrument.

In a preferred embodiment, each of the pad assemblies comprises a traveler plate, a toggle rod, and a toggle pad. The traveler plate has a threaded hole and two wings, the two wings radiating from front and back edges of the traveler plate and being arranged to mate with and slide in the slide channel of the strut. The toggle rod has a threaded bore coupled in the threaded hole of the traveler plate and a turn knob. The toggle pad is coupled to a bottom end of the threaded bore so that turning of the toggle rod via the turn knob in a clockwise or counterclockwise direction vertically lowers or vertically lifts the toggle pad.

In another aspect, the present invention is directed to a method of tuning a stringed instrument. A capo device is provided which has a plurality of pressure pad assemblies mounted for undergoing sliding movement in a first direction transverse to a longitudinal axis of a length of strings of the stringed instrument, each of the pressure pad assemblies having a pressure pad mounted for undergoing vertical movement in a second direction transverse to the longitudinal axis of the strings and transverse to the first direction. The capo device is clamped about a fretboard of the stringed instrument at a fret. The pressure pad assemblies are slid and aligned with underlying strings of the stringed instrument. Selected ones of the pressure pads of the pressure pad assemblies are moved vertically towards corresponding selected underlying strings of the stringed instrument and the selected underlying strings are compressed to selectively tune the stringed instrument at the fret.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings:

FIG. 3 illustrates a top view of the capo device of FIG. 1;

FIG. 4 illustrates a side view of the capo device of FIG. 1;

FIG. 5 illustrates a bottom view of the capo device of FIG. 1;

DETAILED DESCRIPTION OF THE PREFERRED EMBODIMENTS

Figure 1:
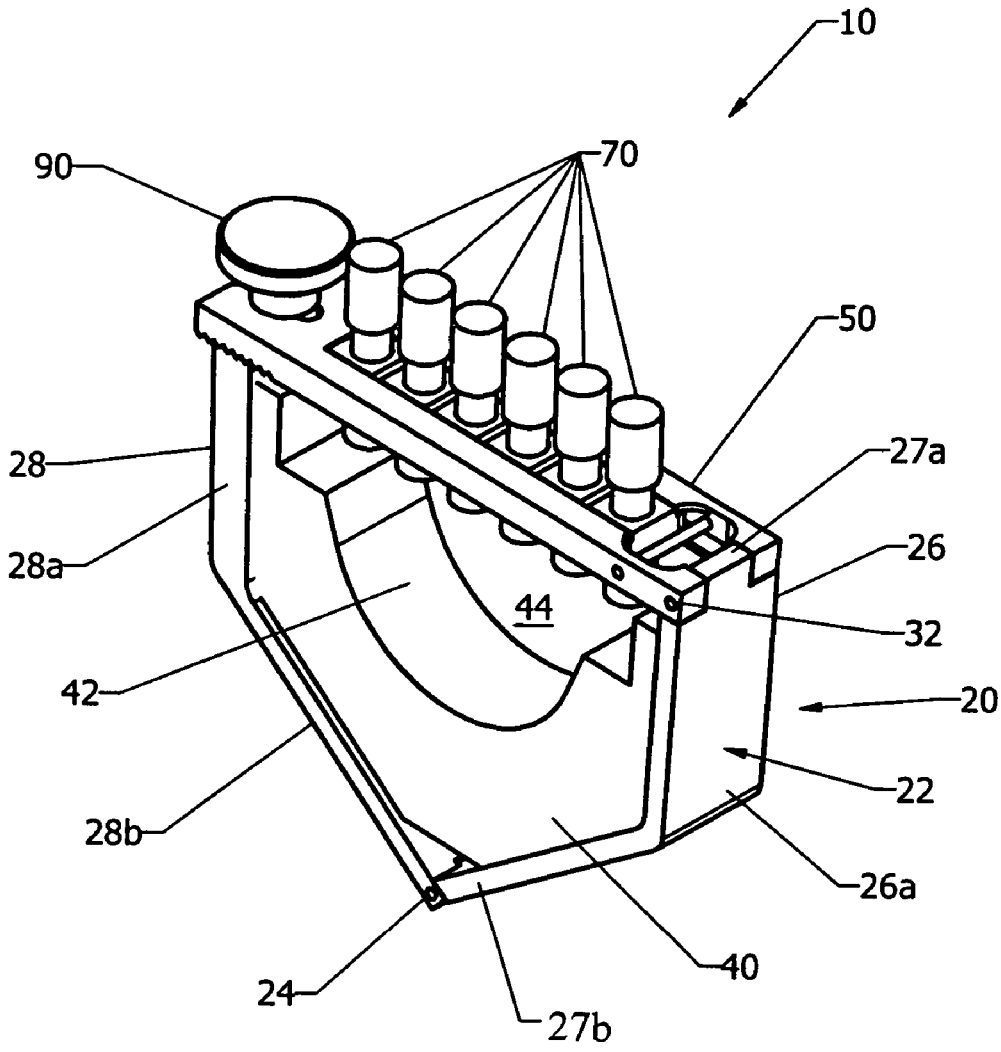
FIG. 1 illustrates a perspective view of a capo device according to the present invention.
Figure 2:
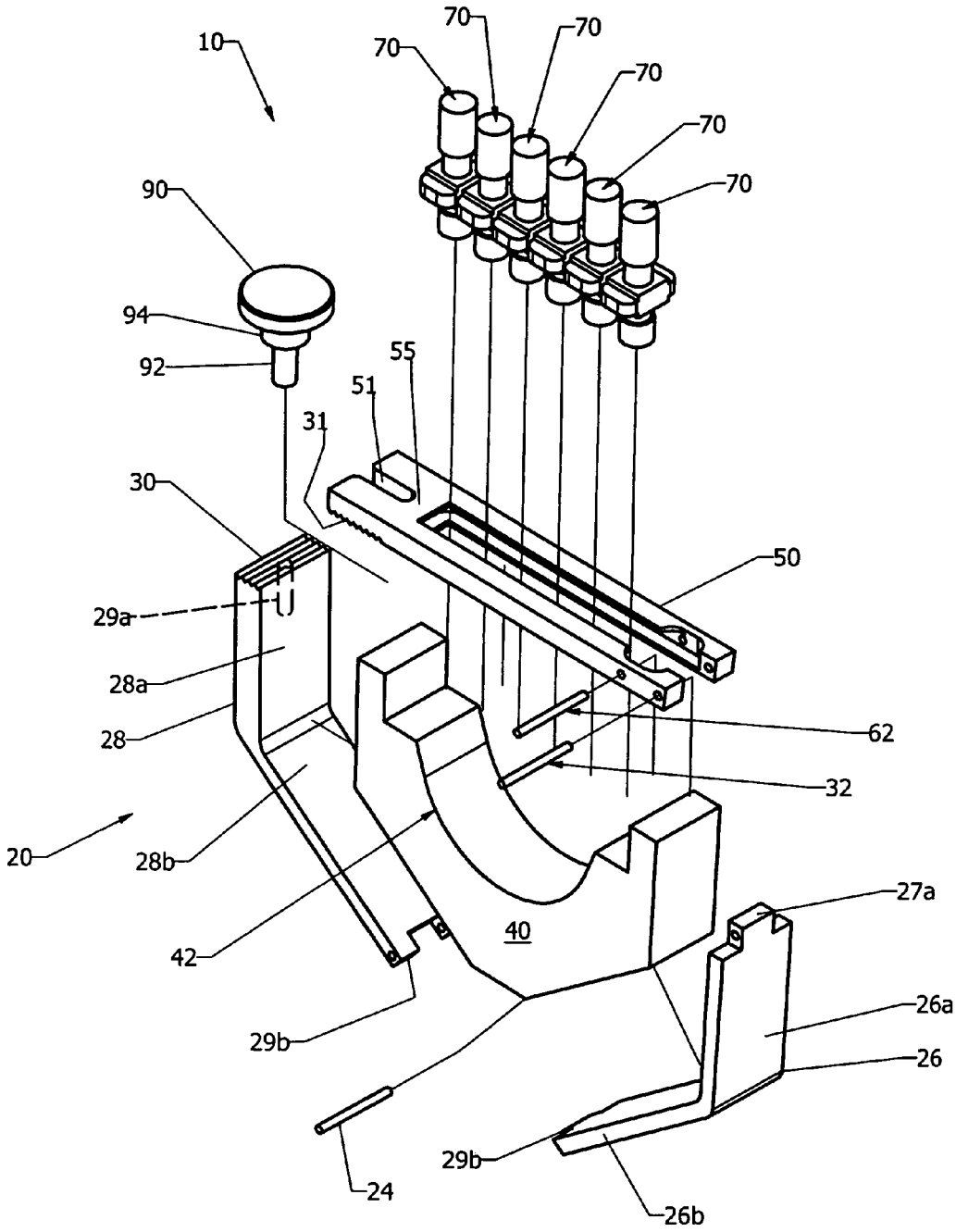
FIG. 2 illustrates an exploded view of the capo device of FIG. 1.

While this invention is susceptible of embodiments in many different forms, this specification and the accompanying drawings disclose only some forms as examples of the use of the invention. The invention is not intended to be limited to the embodiments so described, and the scope of the invention will be pointed out in the appended claims.

The preferred embodiment of the capo device according to the present invention is described below with a specific application to a guitar. However, it will be appreciated by those of ordinary skill in the art that the present invention is also well adapted for other types of stringed instruments.

Referring now to the drawings in detail, wherein like numerals are used to indicate like elements throughout, there is shown in FIGS. 1-12 an embodiment of a capo device, generally designated at 10, according to the present invention.

Referring first to FIGS. 1-5, the capo device 10 includes a universal fretboard clamping assembly 20 having a yoke 22 and a hinged strut member 50 hingedly coupled to one side of the yoke 22. The hinged strut member 50 is intended to be fastened to the other side of the yoke 22 via a fastener 90. The yoke 22 is a two-piece rigid member comprised of members 26, 28 connected together by a hinge pin 24. The two-piece rigid member 26, 28 forms a quasi or generally V-shaped support structure or rigid frame for placement of an elastomeric member 40 therein. The top of the elastomeric member 40 includes a concave recess 42 contoured to provide a cradle 44 for placement of a fretboard 5 of a stringed instrument (FIG. 12) within the fretboard clamping assembly 20.

In the exemplary embodiment, the elastomeric member 40 is made of rubber. The elastomeric member 40 may be made of other elastomeric or resilient material capable of automatically and resiliently conforming or adapting to the structural contour of the fretboard 5. The elastomeric member 40 also prevents scratches or other nicks in the fretboard during clamping, sliding or when the fretboard is being positioned in yoke 22. The elastic and resilient properties of the elastomeric member 40 allow the capo device 10 to be used with and readily adapted for use with different fretboard shapes and styles of stringed instruments. The two-piece rigid member 26, 28 may be made of metal, plastic or other rigid and durable material.

The first member 26 of the yoke 22 is generally V-shaped and has two legs 26*a* and 26*b* separated by an obtuse angle. The free end of the first leg 26*a* includes a hinge member 27*a* for mating connection with one end of the hinged strut member 50. The free end of the second leg 26*b* has a hinge member 27*b*.

The second member 28 of the yoke 22 is generally V-shaped and has two legs 28*a* and 28*b* separated by an obtuse angle. The free end of the first leg 28*a* includes a threaded hole 29*a* as shown in phantom in FIG. 2. The threaded hole 29*a* has a center axis that aligns with the longitudinal length of the first leg 28*a*. The threaded hole 29*a* is adapted to receive a threaded shaft 92 of the fastener 90 which in the exemplary embodiment is a knurled screw. The knurled screw is but one example of a fastener 90 intended to fasten, secure or lock the hinged strut member 50 the top of the second member 28. The free end of the second leg 28*b* has a hinge member 29*b* for mating connection via pin 24 with the hinge member 27*b* of the second leg 26*b* of the first member 26.

The hinged connection defined by the hinge members 27*b*, 29*b* and the pin 24 allows the first and second members 26, 28 of the yoke 22 to undergo pivotal movement relative to one another. Thus, the defined hinged connection allows the yoke 22 to expand or contract such that the angle between the second legs 26*b* and 28*b* of each member 26, 28, respectively, increases or decreases. Thus, the two-piece yoke 22 is capable of selectively adjustable expansion and contraction along the X-axis as the capo device 10 is slid or moved up and down the fretted neck of the stringed instrument. The expansion and contraction capability is one variability provided by the capo device 10 to enable precisely applied compression and universal adaptability.

In the exemplary embodiment, the first legs 26*a* and 28*a* are arranged to be essentially parallel. On the other hand, the second legs 26*b* and 28*b* form a generally V-shaped cavity. The bottom perimeter surface of the elastomeric member 40 is contoured to trace the profile of the interior surfaces of the two-piece yoke 22. However, instead of forming a V shape that tracks the V shape defined by the second legs 26*b* and 28*b*, the bottom apex of the elastomeric member 40 is truncated. Accordingly, as the yoke 22 contracts and expands, the elastomeric member 40 may slide down in the V-shaped cavity during expansion or, alternately, slide up during contraction.

The first leg 28*a* on the second member 28 is thicker than the other legs. Moreover, the top surface of the free end of the first leg 28*a* includes a plurality of ribs 30, the purpose of which is described later.

With specific reference to FIGS. 8-11, the hinged strut member 50 includes, in general, a rectangular structure 52 having two ends 53*a* and 53*b*. The first end 53*a* is hingedly coupled via the hinge pin 32 to the hinge member 27*a*. The second end 53*b* includes, on the underside of the rectangular structure 52, a plurality of ribs 31 intended to mate with ribs 30 of the yoke 22. When the capo device 10 is locked (as will be described later), the ribs 30 and 31 interleave and frictionally engage one another to minimize if not prevent slipping.

The rectangular structure 52 also has formed therein a slide channel 54 for placement of a plurality of adjustable string pressure pad assemblies 70 (FIGS. 1-4) and a slot 51, the slide channel 54 and the slot 51 being separated by a bridge 55. The slot 51 has an open end toward the second end 53*b*. On the other hand, the slide channel 54 has an open end toward the first end 53*a*.

Figure 12:
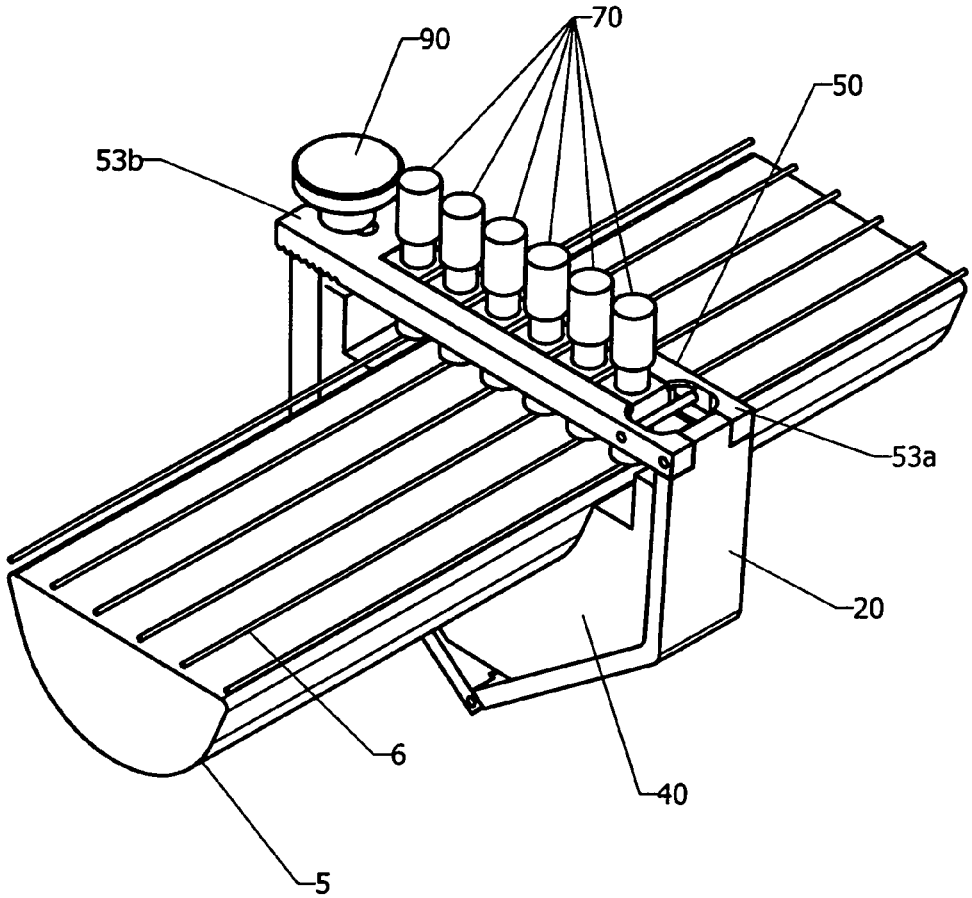
FIG. 12 illustrates a fretboard with a capo device installed thereon.

The hinged strut member 50 and the slide channel 54 extend across the fretboard 5 along an axis (X-axis) that traverses the longitudinal length (Z-axis) of strings 6 of the stringed instrument (FIG. 12). Likewise, the plurality of adjustable string pressure pad assemblies 70 are in a line along the X-axis, the line being transverse to the longitudinal length of the strings 6. Moreover, the length of the slot 51 extends along the X-axis.

Figure 8:
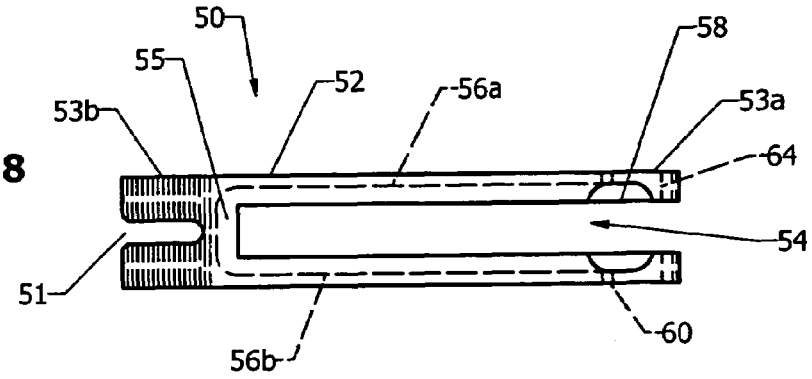
FIG. 8 illustrates a top view of the hinged strut member.
Figure 9:
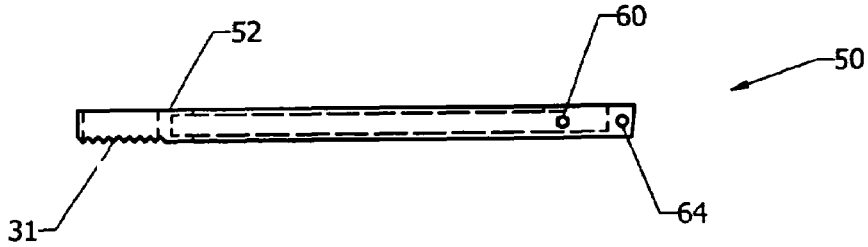
FIG. 9 illustrates a side view of the hinged strut member.
Figure 10:
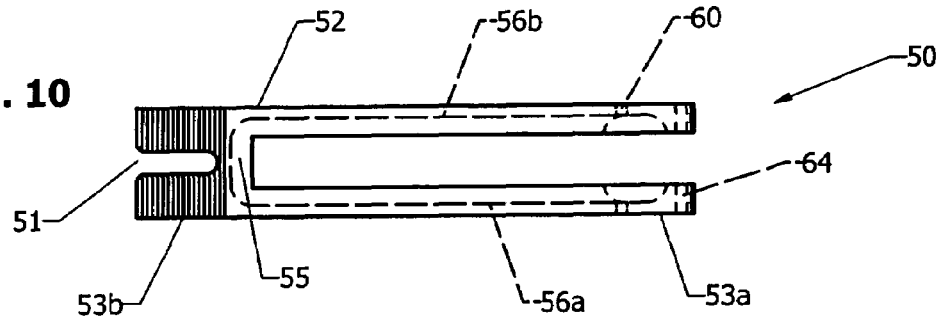
FIG. 10 illustrates a bottom view of the hinged strut member.
Figure 11:
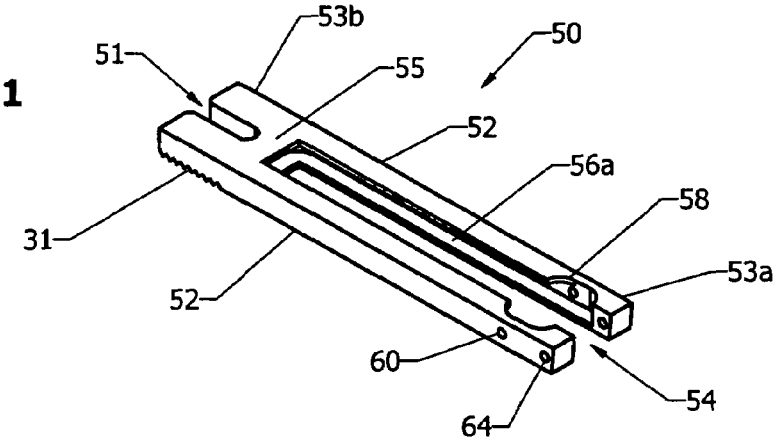
FIG. 11 illustrates a perspective view of the hinged strut member.

The slide channel 54 includes opposing recessed grooves 56*a*, 56*b*, shown in phantom in FIGS. 8, 9 and 10, along opposing interior perimeter sides of the channel 54. Moreover, the hinged strut member 50 is constructed and arranged to include a feed hole 58 for receiving and feeding the adjustable string pressure pad assemblies 70 into the slide channel 54. In the exemplary embodiment, six (6) adjustable string pressure pad assemblies 70 are shown. Alternatively, the feed hole 58 can be used to remove the adjustable string pressure pad assemblies 70 to adapt the capo device 10 to a four (4) or five (5) string stringed instrument. For example, a bass guitar typically has four (4) strings.

In the exemplary embodiment, a through hole 60 extends from side-to-side (across the opening of the slide channel 54) of the hinged strut member 50. The through hole 60 is adapted to receive a locking pin 62 (FIG. 2) to lock the plurality of adjustable string pressure pad assemblies 50 in the slide channel 54. A second through hole 64 is formed in the hinged strut member 50. The second through hole 64 is provided in close proximity to the first end 53*a* and receives the hinge pin 32 (FIG. 2), the first end 53*a* being a hinged end. The locking pin 62 prevents the assemblies 70 from sliding out of the slide channel 54. Once the locking pin 62 is removed, the assemblies 70 can slide in or out of the slide channel 54 via the feed hole 58. Therefore, the capo device 10 can be adapted for or varied for the number of strings of the stringed instrument.

In the exemplary embodiment, since the slide channel 54 is open to the end 53*a*, the frame of the hinged strut member 50 is formed to provide a gap for placement of the hinge member 27*a*. Thus, one side of the hinged strut member 50 is capable of rotation about a Y-axis via the hinge connection with the yoke 22. When installing the capo device 10, the user simply rotates the hinged strut member 50 to an open position via the hinge connection about the pin 32. Thereafter, the fretboard is placed in the cradle 44 in the yoke 22.

The capo device 10 is intended to be securely fastened or locked to the other side of the yoke 22 via the fastener 90. In the exemplary embodiment, the fastener 90 includes a threaded portion 92 and a top knob 94. Below the knob 94, the fastener 90 includes a collar 96 which has a diameter smaller than the diameter of the knob 94 but larger than the width of the slot 51 of the strut member 50. When locking the clamping assembly 20, the fastener 90 is rotated either clockwise or counterclockwise in the threaded hole 29*a* of yoke 22 to enable the guitarist to tighten or untighten the fastener 90. As the fastener 90 is tightened, the collar 96 presses down on the top surface of the hinged strut member 50. Stated otherwise, the collar 96 clamps down on the top surface of the hinged strut member 50. This process allows the universal fretboard clamping assembly 20 to be clamped and then locked to the fretboard. However, in some instances, the compression force exerted by the assemblies 70 to the selected string combination is not applied or may need to be removed.

To move the capo device 10 from a first location on the fretboard 5 to a second location, the clamping force exerted by the collar 96 needs to be removed. To remove the clamping force of the collar 96, the fastener 90 is rotated to raise the collar 96. Thus, the capo device 10 becomes unlocked. Thereafter, the capo device 10 can be slid to a second fret location without the need to remove the clamping assembly 20. Once the capo device 10 is moved to the second fret location, the clamping assembly 20 is re-locked by turning the fastener 90.

As can be appreciated, the width of the fretboard 5 tapers toward the end thereof. The two-piece yoke 22 is capable of expansion and contraction along the X-axis as the capo device 10 is slid or moved up and down the fretboard along the Z-axis. Accordingly, the fastener 90 is slid in the slot 51 of the strut member 50 to accommodate for the expansion and contraction variances of the yoke 22. Moreover, after the universal fretboard clamping assembly 20 is re-locked, the string pressure pad assemblies 70 may need to be adjusted such that the gap G (FIG. 3) between adjacent assemblies 70 is increased or decreased to enhance the precision of the compression to the underlying string 6 of the stringed instrument.

Figure 6:
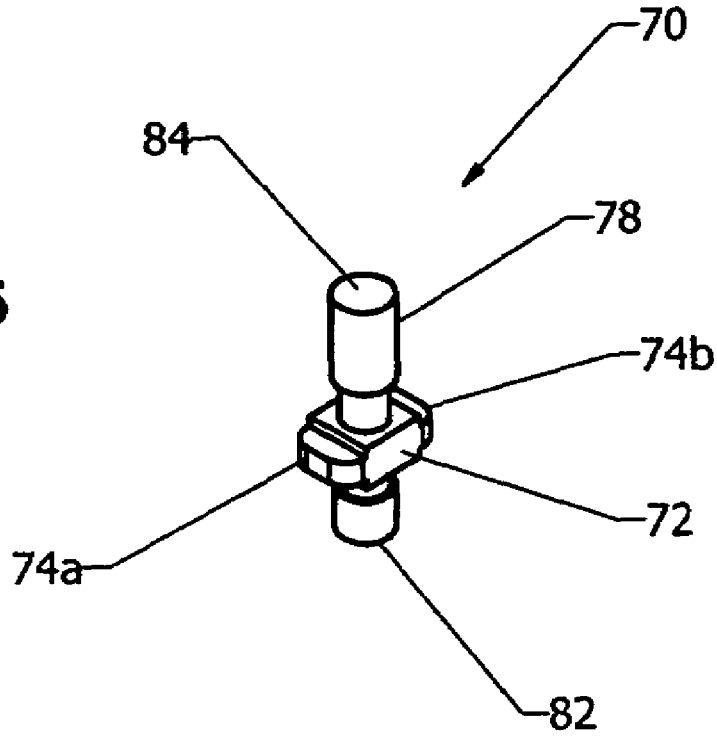
FIG. 6 illustrates a perspective view of the adjustable string pressure pad assembly.
Figure 7:
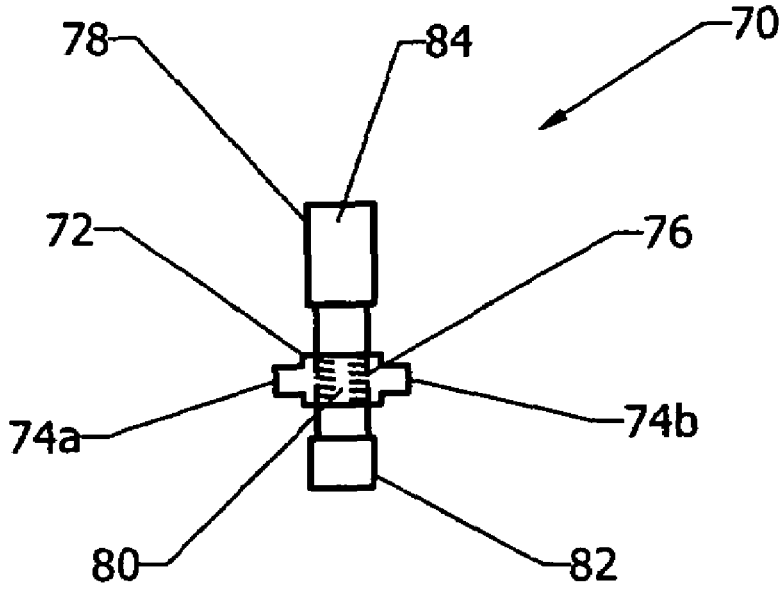
FIG. 7 illustrates a side view of the adjustable string pressure pad assembly of FIG. 6.

Since each of the plurality of adjustable string pressure pad assemblies 70 are the same, only one such pressure pad assembly will be described in detail. As best seen in FIGS. 6 and 7, the assembly 70 includes a traveler plate 72 having two wings 74*a* and 74*b* radiating from the front and back edges of traveler plate 72 and arranged to mate with and slide in the opposing recessed grooves 56*a*, 56*b* along the length of the slide channel 54. The center of the traveler plate 72 includes a threaded hole 76. The assembly 70 further includes a toggle rod 78 having a threaded portion 80 coupled in the threaded hole 76 (shown in phantom in FIG. 7). The bottom end of the threaded portion 80 has a toggle pad 82 coupled thereto. The top end of the threaded portion 80 has a turn knob 84. In the exemplary embodiment, the toggle pad 82 is adapted to be snapped on and off of the bottom end of the threaded portion 80.

In operation, the travelers 72 are slid in the slide channel 54 to align the toggle pads 82 to a position over the strings 6 of the stringed instrument. This provides adjustability along the X-axis by the capo device 10 to provide a more precise compression. Moreover, the assemblies 70 can be removed by sliding the travelers 72 out of the slide channel 54 via the feed hole 58.

The turn knobs 84 provide an expedient and readily accessible means for selectively providing or adjusting compression on any one string 6 by a simple rotation either clockwise or counterclockwise of the toggle rod 78. Screwing the toggle rod 78 clockwise lowers the respective toggle pad 82 to compress the corresponding underlying string 6 down on top of the fretboard 5 at a predetermined fret. Unscrewing the toggle rod 78 counterclockwise raises or lifts the respective toggle pad 82 to reduce or even eliminate any compression on the underlying string 6. Accordingly, any combination of selected toggle pads 82 can be used to create new alternate tunings. Other tunings and permutations can be achieved by moving the capo device 10 up and down the fretboard 5 to a different fret location and picking out various string combinations for compression. Additionally, two or more capo devices 10 can be combined for obtaining additional chords or alternate tunings.

The adjusting capability of the toggle pad 82 in the X-axis and Y-axis directions is another variability provided by the capo device 10 to enable precisely applied compression and various tuning permutations quickly and conveniently. All of the strings 6, or any combination thereof, can be utilized to create new chords or alternate tunings. Thus, the precision to compress the strings 6 is specific and more significant than existing capos.

When using the capo device 10, the universal fretboard clamping assembly 20 is clamped and locked before the compression force is applied by the toggle pad 82. This minimizes damage to the strings. The compression force exerted by the toggle pads 82 applies pressure to the strings selectively, allowing the musician to create new alternate tunings. When sliding, the compression force of all assemblies 70 is lifted or removed as the fastener 90 is unscrewed and the collar 96 lifted. As the collar 96 is lifted, the end 53*b* of the hinged strut member 50 becomes unlocked to eliminate the compression forces. More specifically, as the fastener 90 is rotated counterclockwise, the threaded bore 92 is moved upward in the threaded hole 29*a*. Thereby, the collar 96 is raised.

The universal fretboard clamping assembly 20 is readily adapted for both a typical 6-string guitar and a 4-string bass guitar, by simply sliding off (removing) two of the adjustable string pressure pad assemblies 70. The embodiment shown herein is for a regular 6-string guitar.

The toggle pads 82 are designed to be independent of the threaded rod 78. When the plastic or other material of the toggle pads 82 touches the strings, the toggle pads 82 discontinue rotating to prevent damage or torque to the strings, yet the threaded rods 78 will allow a continued downward pressure, thus locking the strings against the fretboard 5.

The unique construction of the capo device of the present invention allows the capo device to be easily attached to and detached from the fretboard of a stringed instrument in an expeditious fashion. The capo device has a universally adaptable fretboard clamping assembly that allows the assembly to be easily locked and unlocked relative to the fretboard of a stringed instrument. The capo device of the present invention is capable of producing a precise compression suitable for an expert guitarist, and is simple to use and economical to manufacture.

The foregoing description of the embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

I claim:

1. A capo device comprising:

a clamp assembly having a yoke and a strut, the strut having a first end hingedly coupled to a first side of the yoke, a second end securable to a second side of the yoke, and a slide channel arranged to traverse a longitudinal axis of a length of strings on a stringed instrument;

a plurality of pad assemblies, each of the pad assemblies being mounted for undergoing slidable movement in the slide channel of the strut in the direction traversing the longitudinal axis of the instrument strings to a position over an underlying string and for being selectively vertically lowered to compress the underlying string, and each of the pad assemblies comprising (a) a traveler plate having a threaded hole and two wings, the two wings radiating from front and back edges of the traveler plate and being arranged to mate with and slide in the slide channel of the strut, (b) a toggle rod having a threaded portion coupled in the threaded hole of the traveler plate and a turn knob, and (c) a toggle pad coupled to a bottom end of the threaded portion so that turning of the toggle rod via the turn knob in a clockwise or counterclockwise direction vertically lowers or vertically lifts the toggle pad; and an elastomeric member received in the yoke, the elastomeric member having an inner concave recess portion that provides a cradle for a fretboard of the stringed instrument and a generally V-shaped outer portion that contacts inner surfaces of the yoke.

2. A capo device comprising:

a yoke comprised of first and second rigid members hinged together via a hinge pin for undergoing pivotal movement relative each other and relative to a fretboard of a stringed instrument, the first rigid member having a plurality of first ribs formed at an upper surface of a free end thereof and a hole formed in the free end and opening into the upper surface;

a strut member having a first end hingedly coupled to an end of the second rigid member of the yoke, a second end removably securable to the free end of the first rigid member and provided with a plurality of second ribs that engage and mate with the first ribs of the first rigid member when the second end of the strut member is removably secured to the free end of the first rigid member, a slot formed in the second end, a slide channel arranged to traverse a longitudinal axis of a length of strings on the stringed instrument, and a bridge disposed between the slot and the slide channel;

a fastener adapted to be received in the slot of the strut member and into the hole in the free end of the first rigid member of the yoke so that tightening of the fastener removably secures the second end of the strut to the free end of the first rigid member while the first ribs of the first rigid member are in mating engagement with the second ribs of the strut member; and a plurality of pad assemblies, each of the pad assemblies being mounted for undergoing slidable movement in the slide channel of the strut member in the direction traversing the longitudinal axis of the instrument strings to a position over an underlying string and for being selectively vertically lowered to compress the underlying string, each of the pad assemblies comprising (a) a traveler plate having a threaded hole and two wings, the two wings radiating from front and back edges of the traveler plate and being arranged to mate with and slide in the slide channel of the strut, (b) a toggle rod having a threaded portion coupled in the threaded hole of the traveler plate and a turn knob, and (c) a toggle pad coupled to a bottom end of the threaded portion so that turning of the toggle rod via the turn knob in a clockwise or counterclockwise direction vertically lowers or vertically lifts the toggle pad.

3. A capo device according to claim 1; wherein for each of the pad assemblies, the two wings are arranged between the turn knob and the toggle pad for direct engagement with sliding surfaces of the slide channel of the strut.

4. A capo device according to claim 1; wherein the strut has a feed hole dimensioned to receive and feed each pad assembly into the slide channel of the strut, a slot formed in the second end of the strut, and a bridge disposed between the slot and the slide channel of the strut; and further comprising a fastener adapted to be received in the slot of the strut and secured in the yoke so that tightening of the fastener clamps the second end of the strut to the yoke.

5. A capo device according to claim 4; wherein the yoke comprises a first V-shaped rigid member having a first leg with a first free end hinged to the first end of the strut and a second leg with a second free end; and a second V-shaped rigid member having a first leg with a third free end having a threaded hole for receipt of the fastener and a second leg with a fourth free end hingedly coupled to the second free end via a hinge pin, the first legs of the first and second V-shaped rigid members being parallelly aligned relative to each other and the second legs of the first and second V-shaped rigid members being disposed at an angle relative to each other and forming a generally V-shaped structure that receives and closely contacts the generally V-shaped outer portion of the elastomeric member.

6. A capo device according to claim 2; further comprising an elastomeric member having an inner concave recess portion that provides a cradle for a fretboard of the stringed instrument and a generally V-shaped outer portion; wherein the first rigid member of the yoke is generally V-shaped and has a first leg with a first free end hinged to the first end of the strut and a second leg with a second free end, and the second rigid member of the yoke is generally V-shaped and has a first leg with a third free end having the hole for receipt of the fastener and a second leg with a fourth free end hingedly coupled to the second free end via a hinge pin; and wherein in a closed state of the capo device in which the first and second ends of the strut member are hingedly coupled and removably secured, respectively, to the respective ends of the yoke, the first legs of the first and second V-shaped rigid members of the yoke are parallelly aligned relative to each other and the second legs of the first and second V-shaped rigid members of the yoke are disposed at an angle relative to each other and form a generally V-shaped structure that receives and closely contacts the generally V-shaped outer portion of the elastomeric member.

7. A capo device according to claim 6; wherein the elastomeric member has a pair of outer parallel portions contiguous with the V-shaped outer portion, the second V-shaped rigid members of the yoke being configured to receive and closely contact the respective outer parallel portions of the elastomeric member.

8. A capo device according to claim 2; further comprising an elastomeric member having an inner surface that provides a cradle for a fretboard of the stringed instrument and an outer surface that contacts inner surfaces of the first and second rigid members of the yoke, the inner surface having a stepped portion at each of upper opposite ends of the elastomeric member and a concave recess portion between the opposite stepped portions, and the outer surface having a pair of opposite surface portions disposed parallel to each other and a generally V-shaped surface portion disposed between the parallel opposite surface portions.

9. A capo device according to claim 8; wherein the capo device is in a closed state when the first end of the strut member is hingedly coupled to the end of the second rigid member of the yoke and the second end of the strut member is removably secured to the free end of the first rigid member of the yoke; and wherein each stepped portion of the elastomeric member has a seat portion disposed generally parallel to the strut member in the closed state of the capo device.

10. A capo device according to claim 2; wherein for each of the pad assemblies, the two wings are arranged between the turn knob and the toggle pad for direct engagement with sliding surfaces of the slide channel of the strut.

11. A capo device comprising:

a yoke comprised of first and second rigid members hinged together via a hinge pin for undergoing pivotal movement relative each other and relative to a fretboard of a stringed instrument, the first rigid member having a plurality of first ribs formed at an upper surface of a free end thereof and a hole formed in the free end and opening into the upper surface;

a strut member having a first end hingedly coupled to an end of the second rigid member of the yoke, a second end removably securable to the free end of the first rigid member and provided with a plurality of second ribs that engage and mate with the first ribs of the first rigid member when the second end of the strut member is removably secured to the free end of the first rigid member, a slot formed in the second end, a slide channel arranged to traverse a longitudinal axis of a length of strings on the stringed instrument, and a bridge disposed between the slot and the slide channel;

a fastener adapted to be received in the slot of the strut member and into the hole in the free end of the first rigid member of the yoke so that tightening of the fastener removably secures the second end of the strut to the free end of the first rigid member while the first ribs of the first rigid member are in mating engagement with the second ribs of the strut member; and a plurality of pad assemblies, each of the pad assemblies being mounted for undergoing slidable movement in the slide channel of the strut member in the direction traversing the longitudinal axis of the instrument strings to a position over an underlying string and for being selectively vertically lowered to compress the underlying string.

12. A capo device according to claim 11; further comprising an elastomeric member having an inner concave recess portion that provides a cradle for a fretboard of the stringed instrument and a generally V-shaped outer portion; wherein the first rigid member of the yoke is generally V-shaped and has a first leg with a first free end hinged to the first end of the strut and a second leg with a second free end, and the second rigid member of the yoke is generally V-shaped and has a first leg with a third free end having the hole for receipt of the fastener and a second leg with a fourth free end hingedly coupled to the second free end via a hinge pin; and wherein in a closed state of the capo device in which the first and second ends of the strut member are hingedly coupled and removably secured, respectively, to the respective ends of the yoke, the first legs of the first and second V-shaped rigid members of the yoke are parallelly aligned relative to each other and the second legs of the first and second V-shaped rigid members of the yoke are disposed at an angle relative to each other and form a generally V-shaped structure that receives and closely contacts the generally V-shaped outer portion of the elastomeric member.

13. A capo device according to claim 12; wherein the elastomeric member has a pair of outer parallel portions contiguous with the V-shaped outer portion, the second V-shaped rigid members of the yoke being configured to receive and closely contact the respective outer parallel portions of the elastomeric member.

14. A capo device according to claim 11; further comprising an elastomeric member having an inner surface that provides a cradle for a fretboard of the stringed instrument and an outer surface that contacts inner surfaces of the first and second rigid members of the yoke, the inner surface having a stepped portion at each of upper opposite ends of the elastomeric member and a concave recess portion between the opposite stepped portions, and the outer surface having a pair of opposite surface portions disposed parallel to each other and a generally V-shaped surface portion disposed between the parallel opposite surface portions.

15. A capo device according to claim 14; wherein the capo device is in a closed state when the first end of the strut member is hingedly coupled to the end of the second rigid member of the yoke and the second end of the strut member is removably secured to the free end of the first rigid member of the yoke; and wherein each stepped portion of the elastomeric member has a seat portion disposed generally parallel to the strut member in the closed state of the capo device.

* * * * *